US008287063B2

(12) United States Patent
Yan et al.

(10) Patent No.: US 8,287,063 B2
(45) Date of Patent: Oct. 16, 2012

(54) INTELLIGENT WATERLESS PRINTING AND DYEING CONTROL EQUIPMENT AND CONTROL METHOD THEREOF

(75) Inventors: Xinning Yan, Liaoning (CN); Rongjun He, Liaoning (CN)

(73) Assignees: Dandong Unik Textile., Ltd, Dandong, Liaoning (CN); Liaoning Fixed Star Chemicals (Group) Co., Ltd, Dandong, Liaoning (CN)

( * ) Notice: Subject to any disclaimer, the term of this patent is extended or adjusted under 35 U.S.C. 154(b) by 624 days.

(21) Appl. No.: 12/439,336

(22) PCT Filed: Sep. 12, 2007

(86) PCT No.: PCT/CN2007/002698

§ 371 (c)(1),
(2), (4) Date: Feb. 27, 2009

(87) PCT Pub. No.: WO2008/071055

PCT Pub. Date: Jun. 19, 2008

(65) Prior Publication Data

US 2009/0237431 A1 Sep. 24, 2009

(30) Foreign Application Priority Data

Dec. 15, 2006 (CN) ..... 2006 1 0134814
Dec. 20, 2006 (CN) ..... 2006 1 0134918

(51) Int. Cl.
*B41J 29/38* (2006.01)

(52) U.S. Cl. ..... 347/5; 347/9; 700/245

(58) Field of Classification Search ..... 347/5, 9, 347/14; 428/85; 700/245
See application file for complete search history.

(56) References Cited

U.S. PATENT DOCUMENTS 6,139,205 A 10/2000 Suzuki et al.

(Continued)

FOREIGN PATENT DOCUMENTS

CN 1089903 A 7/1994

(Continued)

OTHER PUBLICATIONS

English Translation of PCT International Preliminary Report on Patentability (Form PCT/IEPA/409) issued Apr. 7, 2009 for Application No. PCT/CN2007/002698.

(Continued)

*Primary Examiner* — Lam S Nguyen
(74) *Attorney, Agent, or Firm* — Smith, Gambrell & Russell, LLP

(57) ABSTRACT

The invention relates to an intelligent waterless printing and dyeing control equipment and a control method thereof. The equipment comprise of: a control apparatus consisting of a programmable logic controller and a superior monitor computer and a robot, wherein, the programmable logic controller communicates with the superior monitor computer via MPI bus, receiving control signal coming from an operating panel and the robot via digitals input module for transmitting the control command to the robot, connecting with the dye conveyer apparatus and the printing and dyeing apparatus via the digitals output module; the superior monitor computer communicates with the servo controllers via CAN bus. The method includes the following steps that setting up Y-axis in cloth operational direction and X-axis in the direction which is perpendicular to the cloth operational direction to establish a plane of printing and dyeing; setting up two electronic cams which use a same virtual main shaft in the servo controllers; downloading edited jet painting formulation from the superior monitor computer into the servo controllers; completing the jet painting operation through the electronic cams. The invention achieves a purpose of screen-free, waterless and intellectualization, and has properties of an environment protection and reducing production cost due to no consumption of fresh water.

20 Claims, 6 Drawing Sheets

U.S. PATENT DOCUMENTS

| | | | | |
|---|---|---|---|---|
| 6,612,675 | B1 | 9/2003 | Takahashi | |
| 6,705,717 | B1 | 3/2004 | Fujita et al. | |
| 7,577,497 | B2 * | 8/2009 | Johannessen et al. | 700/245 |
| 2003/0085935 | A1 | 5/2003 | Aiba | |
| 2005/0106355 | A1 * | 5/2005 | Kohlman et al. | 428/85 |

FOREIGN PATENT DOCUMENTS

| | | | |
|---|---|---|---|
| CN | 1236706 | A | 12/1999 |
| CN | 1366108 | A | 8/2002 |
| CN | 1417029 | A | 5/2003 |
| JP | 2004-291394 | | 10/2004 |

OTHER PUBLICATIONS

English Translation of the PCT Written Opinion of the International Searching Authority (FORM/ISA/237) issued Dec. 12, 2007 for Application No. PCT/CN2007/002698.

* cited by examiner

INTELLIGENT WATERLESS PRINTING AND DYEING CONTROL EQUIPMENT AND CONTROL METHOD THEREOF

FIELD OF THE INVENTION

The invention relates to printing and dyeing equipment, particularly, to an intelligent waterless printing and dyeing control equipment and a control method thereof.

BACKGROUND OF THE INVENTION

Textile printing equipment nowadays both domestically and internationally is mainly of mechanical type which features in lower automation and lower productivity. Taking the flat screen printing machine and the rotary screen printing machine which represent main stream machines in the present market as an example, they have three major shortcomings: firstly consuming a great volume of fresh water and draining a large volume of polluted water which heavily consume resource and badly pollute environment; secondly printing patterns implemented only through printing screens having one color for each, thus resulting in a long periodic technical process with drawbacks of less color range, high cost of screen making, heavy pollution in screen washing; and thirdly featuring in lower level of automation and intellectualization, heavy intensity of labor and lower productivity.

The intelligent printing and dyeing equipment has become a hotspot topic of R & D worldwide in recent years and among which the most representative one is the ink-jet printing machine. The equipment makes use of its computer software system to print the stored printing pattern design onto the pretreated textiles via its ink-jet printing machine and then fix up the color through steaming, wash off the loose color to complete the whole process. But this technique is still not ready to be put into industrial production because of its rather high cost, lower output speed, and some problem, in key links of technology, such as nozzles and dyes and environmental protection. So the world is waiting for a break-through in industrialized, on-scale and continuous intelligent waterless printing on textiles at present stage.

SUMMARY OF THE INVENTION

In order to overcome the above-mentioned lack of high consumption, heavy pollution and lower productivity, the invention provides the intelligent waterless printing and dyeing control equipment and control method thereof which aims at a screen-free, waterless, digital and intelligent textile printing process and finally realize a green production of fabrics.

The intelligent waterless printing and dyeing control equipment comprises a dye conveyer apparatus and a printing and dyeing apparatus connecting to the terminal of the dye conveyer apparatus; and a control apparatus which is comprised of a programmable logic controller and a superior monitor computer and a robot, wherein, the programmable logic controller communicates with the superior monitor computer via MPI bus, receiving control signal coming from an operating panel and the robot via digital input module and transmitting the control command to servo controllers of the robot via bus, connecting with the dye conveyer apparatus and electric execution devices in the printing and dyeing apparatus via the digital output module, and connecting with the servo controllers of the robot via relays; the superior monitor computer, storing a control program, communicates with the servo controllers via CAN bus; nozzles of the painting and dyeing apparatus is mounted on the robot forming an interlock system with each other.

The said robot installing on a printing and dyeing framework is of one or more groups of plane rectangular structure, each group has X-axis servo motor and Y-axis servo motor controlled by X-axis servo controller or Y-axis servo controller respectively; an effective travel of X-and Y-axis servo motors forming a printing and dyeing plane, position feedback sensors on each axis servo motor feed back the position signals to the servo controllers; a digital frequency output terminal of X-axis servo controller connects with a digital frequency input terminal of Y-axis servo controller; an enabling input terminal of the servo controller connect with contact points of the relays controlled by the programmable logic controller; both X-axis servo motor and Y-axis servo motor change rotating movement into rectilinear movement of X-axis and Y-axis via a drive mechanism then control the movement of the nozzles in the printing and dyeing apparatus; wherein, X-axis servo motor which is mounted on the printing and dyeing framework connects with Y-axis rail via the drive mechanism; Y-axis servo motor on Y-axis rail connects with a sliding block is mounted on Y-axis rail via a drive mechanism; the nozzles on the sliding block forms an interlock system together with the sliding block; both X-axis and Y-axis rails are of horizontal mounting (i.e., be placed horizontally) and perpendicular positioning to each other (when X-axis rail is perpendicular to the forward motion direction of cloth, the Y-axis rail is parallel to the forward motion direction of cloth); Y-axis rail is supported on a horizontal rail.

Based on the data of printing pattern edited by the superior monitor computer and through displacement on X-axis and Y-axis, electronic cams are established individually in X-axis and Y-axis servo controllers by making use of their interior function block; a virtual main shaft is established in the X-axis servo controller and the speed of the virtual main shaft is transmitted to the digital frequency input terminal of Y-axis servo controller via the digital frequency output terminal of the X-axis servo controller and, in this way, the movement of X-axis and Y-axis by following up the same virtual main shaft is realized and, a corresponding data storage area in X-and Y-axis servo controllers saving curve data from each electronic cam downloading from the superior monitor computer are structured.

The above mentioned electric execution devices refer to the solenoid valves which are installed in the dye conveyers apparatus and the printing and dyeing apparatus.

High-speed solenoid valves connecting with the programmable logic controller are set on the nozzles; the programmable logic controller receives parameters of open/close time setting up by the superior monitor computer and for controlling the open/close operation of the high-speed solenoid valves through an establishment of different combinations of solenoid valve open/close time resulting in development of diversification of printing pattern.

The above mentioned superior monitor computer processes graphics user interface; the said computer connects with other remote computers through local area network.

The intelligent waterless printing and dyeing control method, implemented through the control program storing in the superior monitor computer, including steps as follows:

Setting up Y-axis in cloth operational direction and X-axis in the direction which is perpendicular to the cloth operational direction to establish a plane of printing and dyeing;

Setting up two electronic cams, X-axis electronic cam and Y-axis electronic cam, which use a same virtual main shaft in the servo controllers;

Editing jet painting formulation in the graphics user interface of the superior monitor computer;

Downloading edited jet painting formulation into the servo controllers;

Starting up the servo controllers and completing the jet painting operation through the electronic cams.

Wherein, the steps of editing the jet painting formulation include: editing jet painting curve; optimizing the jet painting curve; analyzing the optimized jet painting curve; determining whether the optimization meets the technical criteria of jet painting, wherein stimulating to display the jet painting result if the technical criteria of jet painting is met; then judging whether the jet painting effect is satisfactory, preserving the jet painting curve if the jet painting result is satisfactory; setting up parameters for servo controllers and solenoid valves and returning back to the main program; if the result of optimization does not meet the technical criteria of jet painting, returning back to the step of optimizing jet painting curve; if the effect of jet painting is not satisfactory returning back to the step of editing jet painting curve.

The steps of optimizing jet painting curve include: reading a jet painting displacement curve; judging whether the displacement curve is complete; trimming the curve if the above judgment is not satisfactory; calculating the varying rate of the curve in the commencing section; then calculating the cycle and amplitude of the sinusoidal which has identical varying rate of the curve; replacing an original jet painting curve in the commencing section with one-fourth wavelength sinusoidal; calculating the varying rate of the jet painting curve in the terminating section; calculating the cycle and amplitude of the sinusoidal which has identical varying rate of the curve in the terminating section; replacing an original jet painting curve in the terminating section with one-fourth wavelength sinusoidal; carrying out mean filtering for the jet painting curve and realizing a smooth optimization for displacement curve on X-axis and Y-axis; returning back to the sub-program of the editing jet painting curve and continuing the step of analyzing the optimized jet painting curve.

The steps of analyzing the optimized jet painting curve include: reading the jet painting displacement curves on X-axis and Y-axis among the jet painting curves; judging whether the displacement curves meet the design requirements, differentiating the displacement curves on X-axis and Y-axis respectively to obtain the X-axis and Y-axis jet painting speed curves if the design requirements are met; judging whether X-axis and Y-axis jet painting speed curves meet the requirements of the servo controllers, differentiating the speed curves on X-axis and Y-axis to obtain the X-axis and Y-axis acceleration curves if the requirements of the servo controllers are met; judging whether the X-axis and Y-axis acceleration curves meet the requirements of the servo controllers, qualifying the edited jet painting curves by meeting the requirements of the servo controllers, and then returning back to the sub-program of editing the jet painting for mutation to continue the step of judging whether the optimized curves are qualified.

The edited jet painting curves will be determined unqualified if at least one out of the above mentioned results of judgment is not acceptable, then returning back to the sub-program of editing formulation and continue to go through the step of judging whether the optimized curves are qualified.

The invention has the following advantages and useful results.

1. Achieved screen-free, waterless and intellectualized textile printing and dyeing machine by using the present invention. The control method provided by the invention is of robot intelligent control process instead of human control method and the printing screen in traditional printing equipment is eliminated. Thus, the fresh water is saved and polluted water is reduced simultaneously. Good progress is achieved both in environment protection and continuous industrial production.

2. A completely new style of printing pattern can be realized and production cost is reduced. The technique of the invention is applied to intellectualized equipment implementing an intelligent printing through program control. A completely new style of printing pattern with short flow is achieved and a major problem of each color demanding one screen in traditional textile printing is solved. It greatly reduces production cost due to no consumption of fresh water.

3. Having repeatability for printing and dyeing. The intelligent control of the invention has solved the problem of labor intensity and increased the productivity as well as changed the situation of mono printing pattern and long duration of printing pattern design. A mass production is realized.

4. Representing a tendency of development of textile printing and dyeing industry by employing the invention. Accordingly, competitiveness of textile products is enhanced. The completely new style of printing pattern given by the invention added additional value upon textile product. Features of intelligence, environment protection, shorten flow printing of the invention help sustainable development in the printing and dyeing industry.

BRIEF DESCRIPTION OF DRAWINGS

As shown in FIG. 1, the intelligent waterless printing and dyeing control equipment comprising: the dye conveyer apparatus(or dyestuff delivery mechanism) and the printing and dyeing apparatus(or spray drawing device) connecting to the terminal of the dye conveyer apparatus; and the control apparatus which is comprised of the programmable logic controller and the superior monitor computer and the robot, wherein, the programmable logic controller communicates with the superior monitor computer via MPI bus, receiving control signal coming from the operating panel and the robot via DI (digital input) module and transmitting the command of control signal to the servo controllers of the robot via bus, connecting with the dye conveyer apparatus and the electric execution devices in the printing and dyeing apparatus via the DO (digital output) module, and connecting with the servo controllers of the robot via relays; the superior monitor computer communicates with the servo controllers via CAN bus; the nozzles of the painting and dyeing apparatus is mounted on the robot forming an interlock system with each other; a control program is stored in the superior monitor computer.

Figure 1:
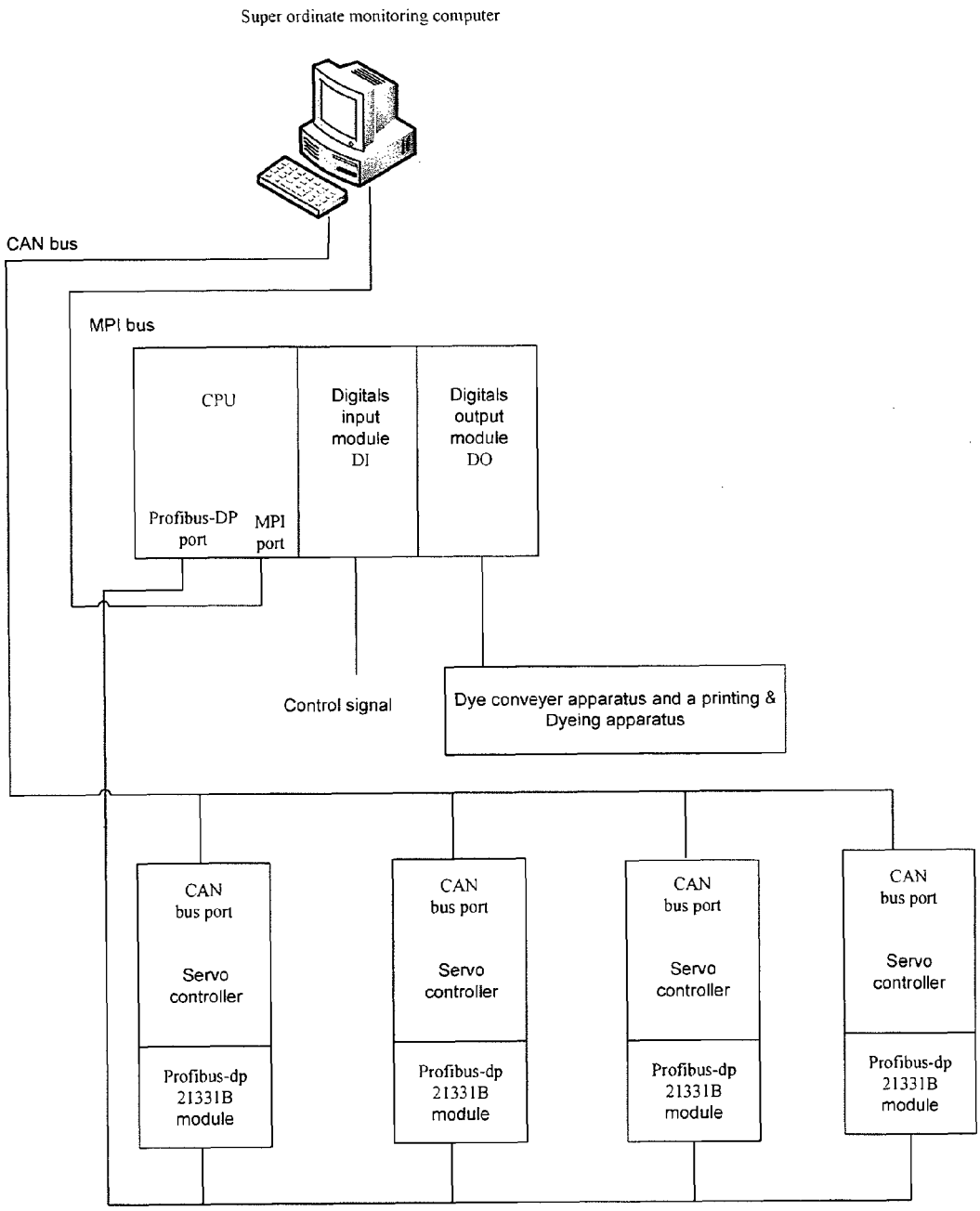
FIG. 1 is a diagram of the invention's structure.

The electric execution devices adopting solenoid valves, in this example, are 12 pieces in total, eight of them are mounted at bottom of the nozzles for controlling the open/close operation, and four of them are mounted in a dye conveyer cabinet for controlling pneumatic source by regulating disc pumps to convey dye material.

The programmable logic controller consists of a CPU (central processor module unit), Siemens 315-2DP), a DI (digital input) module (SM321, 32 points input) and a DO (digital output) module (SM 322, 16 points relay output). Wherein the central processor module unit CPU connects with the servo controllers of the robot via bus interface (Profibus-DP, CPU per se supplied) and the servo controllers connect with the superior monitor computer via CAN bus. The digitals output module DO connects with an enabling terminal of the servo controller via the relay. The digitals input module DI receives the manual or automatic mode selection from the X/Y-axis. The programmable logic controller communicates with the servo controllers via bus. The digitals input module DI receives point start operation within the printing and dyeing plane(spray drawing plane) under manual mode (realizes communication with the servo controllers via PLC); The digitals input module DI receives the start/stop operation under automatic mode and limit switch signal from the robot walking area (X-axis limit switch installed on X-axis rail of the printing and dyeing plane of the robot and Y-axis limit switch installed on the Y-axis rail, communicate with the servo controllers which are realized via PLC) as well. The programmable logic controller acquires limit signals from the servo controllers via bus for manual control. The mode selection switch is mounted on the panel.

The said robot is of one or more groups of plane rectangular structure, each group has X-axis servo motor and Y-axis servo motor controlled by the X-axis servo controller or Y-axis servo controller respectively. The position feedback sensor of each axis servo controller feeds back the robot position signals to the position feedback input terminal of the servo controller. The digit frequency output terminal of the X-axis servo controller connects with the digit frequency input terminal of the Y-axis servo controller.

The said robot installing on the printing and dyeing framework (under which there is cloth to be printed and dyed) is of one or more groups of plane rectangular configuration (two groups in this example). On each group of robot there are X-axis servo motor and Y-axis servo motor controlled by X-axis servo controller and Y-axis servo controller separately (servo controllers in this example are of Lenze EVS 9323 EK and Lenze 9324 EK). The effective travel of X-and Y-axis servo motors form the printing and dyeing plane. The position feedback sensors (in this example they are of rotary transformers) on each axis servo motor feed back the position signals to the servo controller. The digital frequency output terminal of X-axis servo controller connects with the digital frequency input terminal of Y-axis servo controller to realize the speed transmission between X-axis and Y-axis for robot. The enabling input terminal of the servo controller(s) connects with the contact points of the relays controlled by the programmable logic controller. Both the X-axis servo motor and Y-axis servo motor change the rotating movement into rectilinear movement of X-axis and Y-axis via a drive mechanism so as to control the movement of the nozzles in the printing and dyeing apparatus.

X-axis servo motor which is mounted on the printing and dyeing framework connects with Y-axis rail via a drive mechanism; Y-axis servo motor on Y-axis rail connects with a sliding block mounting on Y-axis rail via a drive mechanism; The nozzles on the sliding block forming an interlock system together with the sliding block; Both X-axis and Y-axis rails are of horizontal mounting(i.e., be placed horizontally) and perpendicular positioning to each other (when X-axis rail is perpendicular to the forward motion direction of cloth, the Y-axis rail is parallel to the forward motion direction of cloth); Y-axis rail is supported on a horizontal rail.

In the example, based on the data of printing pattern edited by the superior monitor computer and through displacement on X-and Y-axis, two electronic cams are established individually in the X-axis and Y-axis servo controllers by making use of their interior function block. A virtual main shaft is established in the X-axis servo controller and the speed of the virtual main shaft is transmitted to the digital frequency input terminal of Y-axis servo controller via the digital frequency output terminal of the X-axis servo controller and, in this way, the movement of X-axis and Y-axis by following up the same virtual main shaft is realized and thus achieves a synchronous operation position of robot within the printing and dyeing plane and in turn, the curve data from each electronic cam are downloaded to corresponding data storage area in X-axis and Y-axis servo controllers via the superior monitor computer.

There are graphics user interfaces in the superior monitor computer for man-machine conversation.

Siemens CP5611 PROFIBUS MPI communication card inserting in the superior monitor computer can realize digital communication with the programmable logic controller. Lenze CAN bus controller (USB interface) mainly carries out edition and parameter configuration for the servo system and downloads the printing and dyeing curves to the servo controllers. In addition, the superior monitor computer also carries out the edition and trimming of printing and dyeing curves, the monitoring and readjustment parameters of equipment operation, such as the setting up and modification of virtual main axis speed and etc.

The whole system consists of two sets of plane rectangular coordinates robot, each of which operates independently or operates in interaction with each other.

The dye conveyer apparatus consists of four groups of disc pump supplying dyes in four colors. Each plane rectangular coordinates robot has four groups of nozzles (connected with the programmable logic controller receiving open/close signals as the superior monitor computer sets up the open/close time and sending open/close signals to high-speed solenoid valve). The open/close operations of nozzles are controlled by four high-speed solenoid valves. The open/close time of the nozzles may be set by the superior monitor computer, or linked by reaching to a certain position. Different combinations of nozzle open/close time lead to a diversification of printing pattern.

The programmable logic controller carries out data exchange with the superior monitor computer through MPI bus, carries out data exchange with the servo controllers through PROFIBUS bus, carries out dye conveying, open/close controlling of solenoid valves of each nozzle, the indications of power-on, operation, stop and working status of the whole system through the interior logic program of the programmable logic controller, and supervises the status of the servo controllers through reading the current operation parameters of the servo controllers and transmits these parameters to the superior monitor computer for graphical display.

Since the superior monitor computer is capable of storing the parameters in the whole process of printing and dyeing in the form of formulation so the repeatability of printing patterns may be realized.

The superior monitor computer may carry out remote communication with other equipment through the Ethernet card which is installed on the computer.

Figure 2:
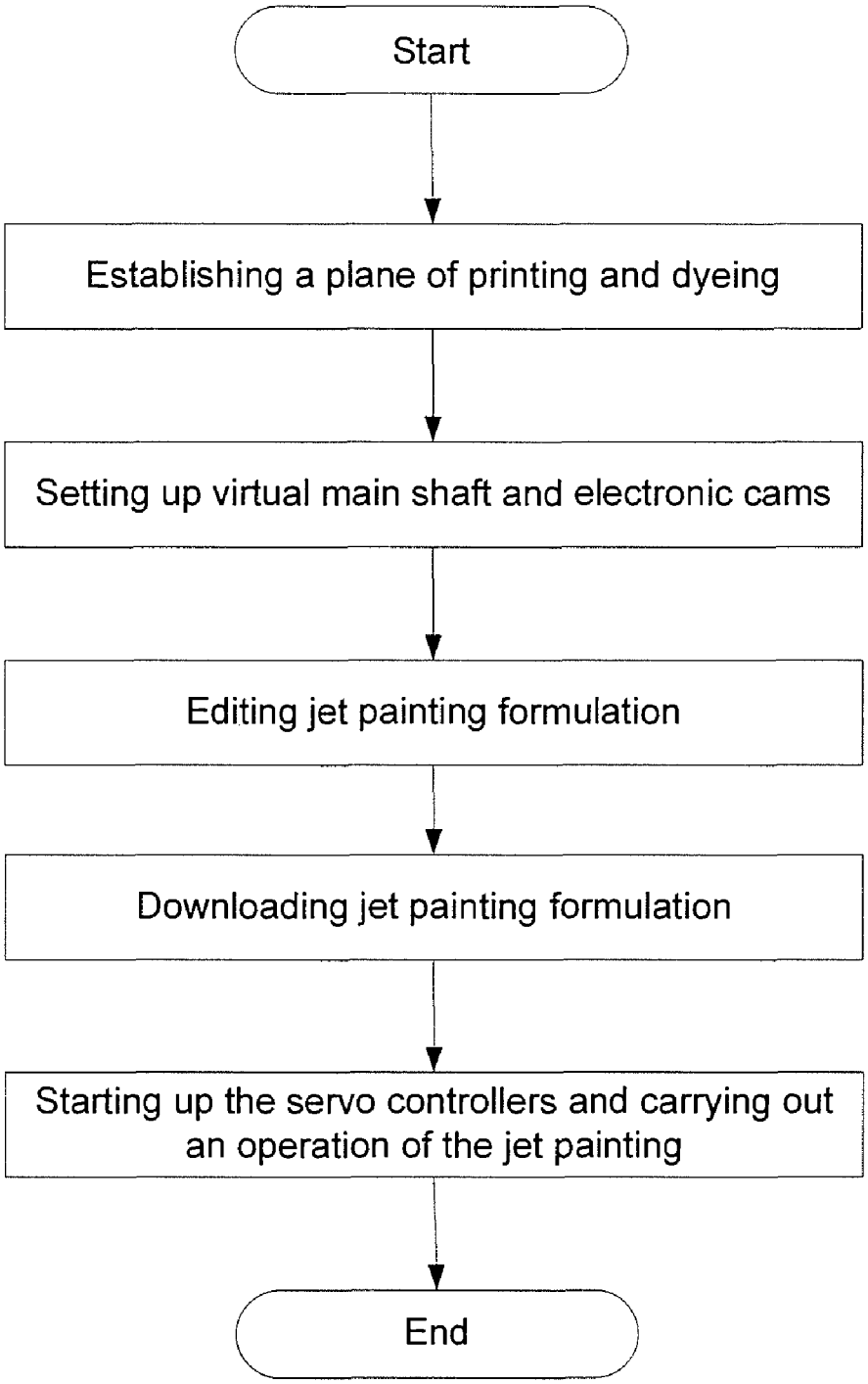
FIG. 2 is a flow chart of main program of the control process proved by the invention.

As shown in FIG. 2, the control method of the intelligent waterless printing and dyeing control equipment is implemented through the controlling programs storing in the superior monitor computer. The following steps are involved in the main program:

A. Taking the cloth operation direction as Y-axis (the travel of Y-axis is 200 mm in this example) and the direction which is perpendicular to the cloth operation direction as X-axis (the travel of X-axis is 1800 mm in this example) to establish the plane of printing and dyeing.

B. Setting up two electronic cams, i.e., X-axis electronic cam and Y-axis electronic cam in the servo controllers. These two cams are driven by the same virtual main shaft.

Figure 3:
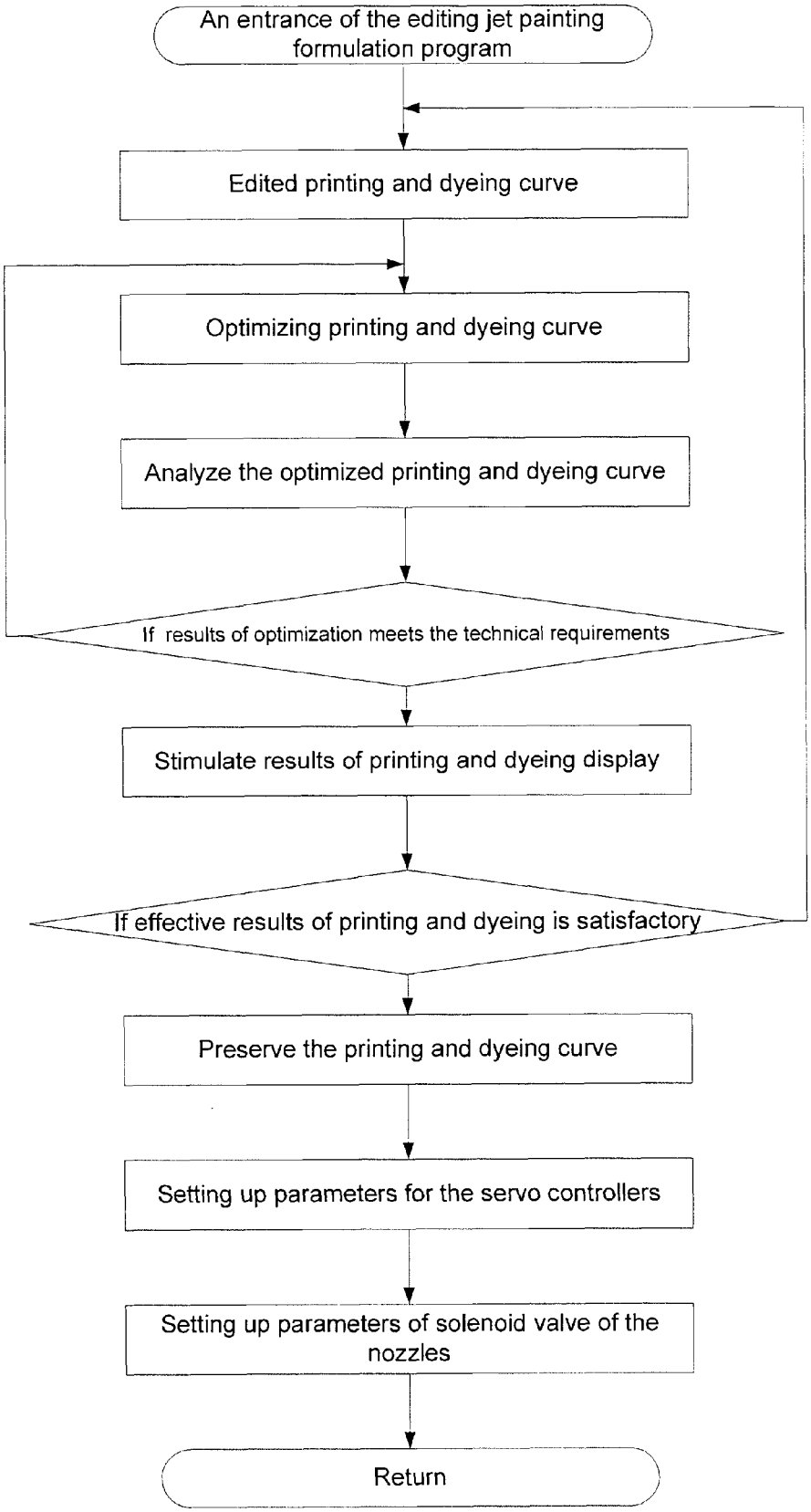
FIG. 3 is a flow chart of the sub-program of editing jet painting formulation of the main program of the control process.

C. Editing jet painting formulation in the graphics user interface of the superior monitor computer. As shown in FIG. 3, the edited printing and dyeing formulation includes edited printing and dyeing curve and optimizing printing and dyeing curve, and analyze the optimized printing and dyeing curve; Stimulate the result of printing and dyeing display if the result of optimization meets the technical requirements; Preserve the printing and dyeing curve if the above mentioned result of printing and dyeing is satisfactory; Set up the parameters for the servo controllers(mainly including the X-axis scaling, Y-axis scaling, X-axis speed follow-up coefficient, speed settings of the virtual main axis, number of robot (one or two, if two, then further requirement to set up the movement time delay between the two robots is necessary), the manual/auto working mode of the solenoid valve of the nozzles (can be set up separately or independently) and the parameters of solenoid valve of the nozzles (including manual/auto working mode of solenoid valve of the nozzles, the open/close frequency of the solenoid valve under auto mode, i.e., the open/close time (unit: in second) of the solenoid valve), then return back to the main program.

If the above mentioned result of optimization does not meet the technical requirements of printing and dyeing, return back to the step of optimizing printing and dyeing curve; If the above mentioned effective result of printing and dyeing is not satisfactory, return back to the step of editing printing and dyeing curve.

The editing of printing and dyeing curve can be as follows: to generate regular jet painting through curve function, or to draw a two dimensional jet painting curve in specified area to control a mouse by using a timer, or to form a new jet painting curve by intercepting any piece from the regular curve and hand drawn curve, wherein, a cycle and an amplitude of the regular jet painting curve can be freely set up by parameters. Regular jet painting curves include straight line, sinusoidal, saw-teeth wave curve, parabola curve, semi-circular curve, double semi-circular curve and quadratic curve and etc.

Figure 4:
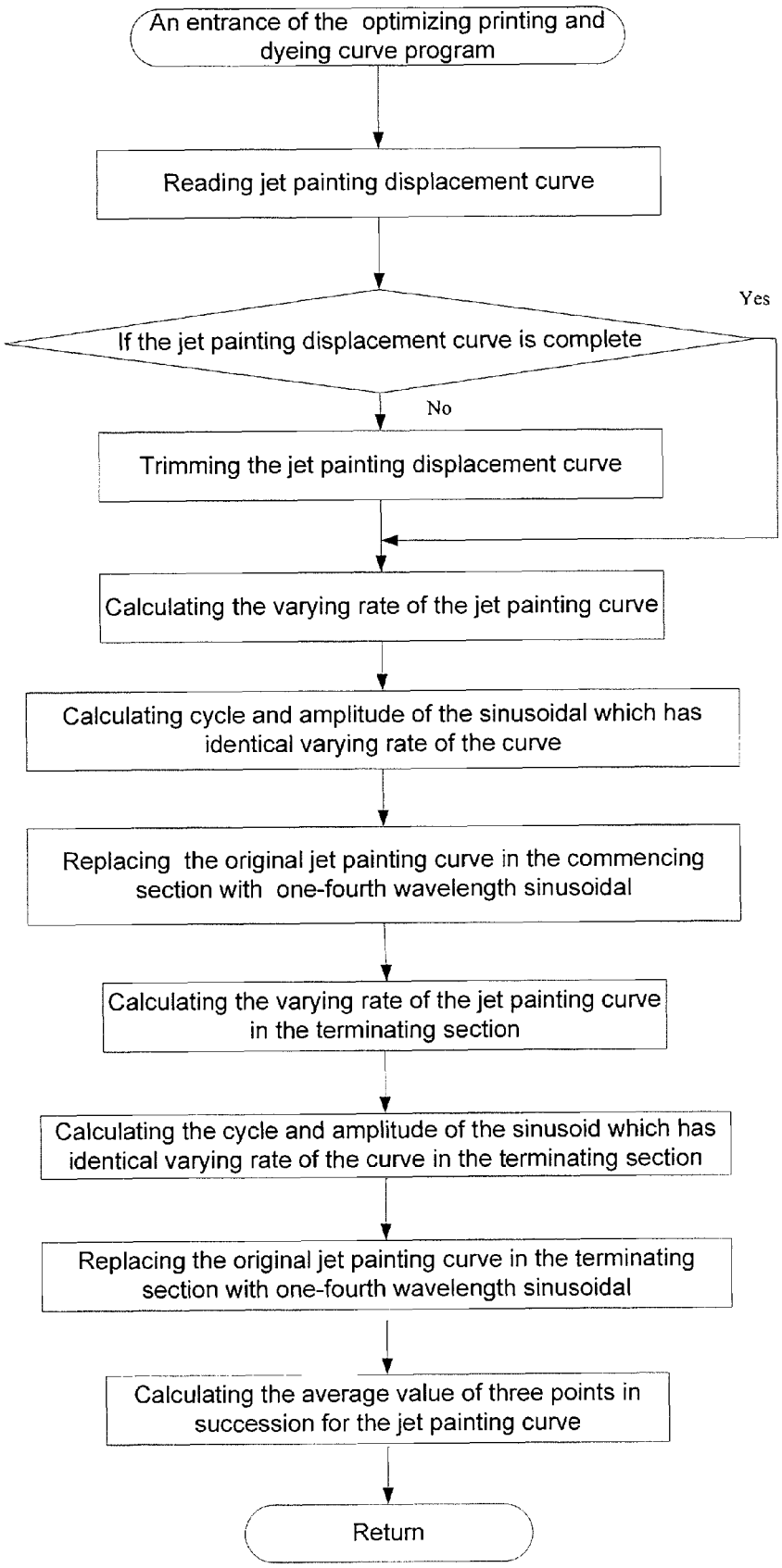
FIG. 4 is a flow chart of the sub-program of optimizing jet painting curve of the sub-program of editing jet painting formulation of the control process.

The above mentioned optimizing jet painting curve includes the following steps as shown in FIG. 4: reading jet painting displacement curve; determining whether the jet painting displacement curve is complete (in this example the detailed criteria of determination is: the start point of the displacement must be 0, any point of the coordinates varying range on X-axis displacement curve must be between 0 to 1800, not overstepping the travel range of X-axis, any point of the coordinates varying range on Y-axis displacement curve must be between 0 to 200, not overstepping the travel range of Y-axis). If the result of the above mentioned determination is not satisfactory, trimming the jet painting displacement curve; calculating the varying rate of the jet painting curve in the commencing section; calculating the cycle and amplitude of the sinusoidal which has identical varying rate of the curve; using one-fourth wavelength sinusoidal to replace the original jet painting curve in the commencing section; calculating the varying rate of the jet painting curve in the terminating section; calculating the cycle and amplitude of the sinusoid which has identical varying rate of the curve in the terminating section; using one-fourth wavelength sinusoidal to replace the original jet painting curve in the terminating section. Then calculate the average value of three points in succession by using super-average filtration optimization algorithm for carrying out smooth optimization for X-and Y-axis displacement curves; Finally return back to the sub-program of the editing jet painting curve and continue the step of analyzing the optimized jet painting curve.

Figure 5:
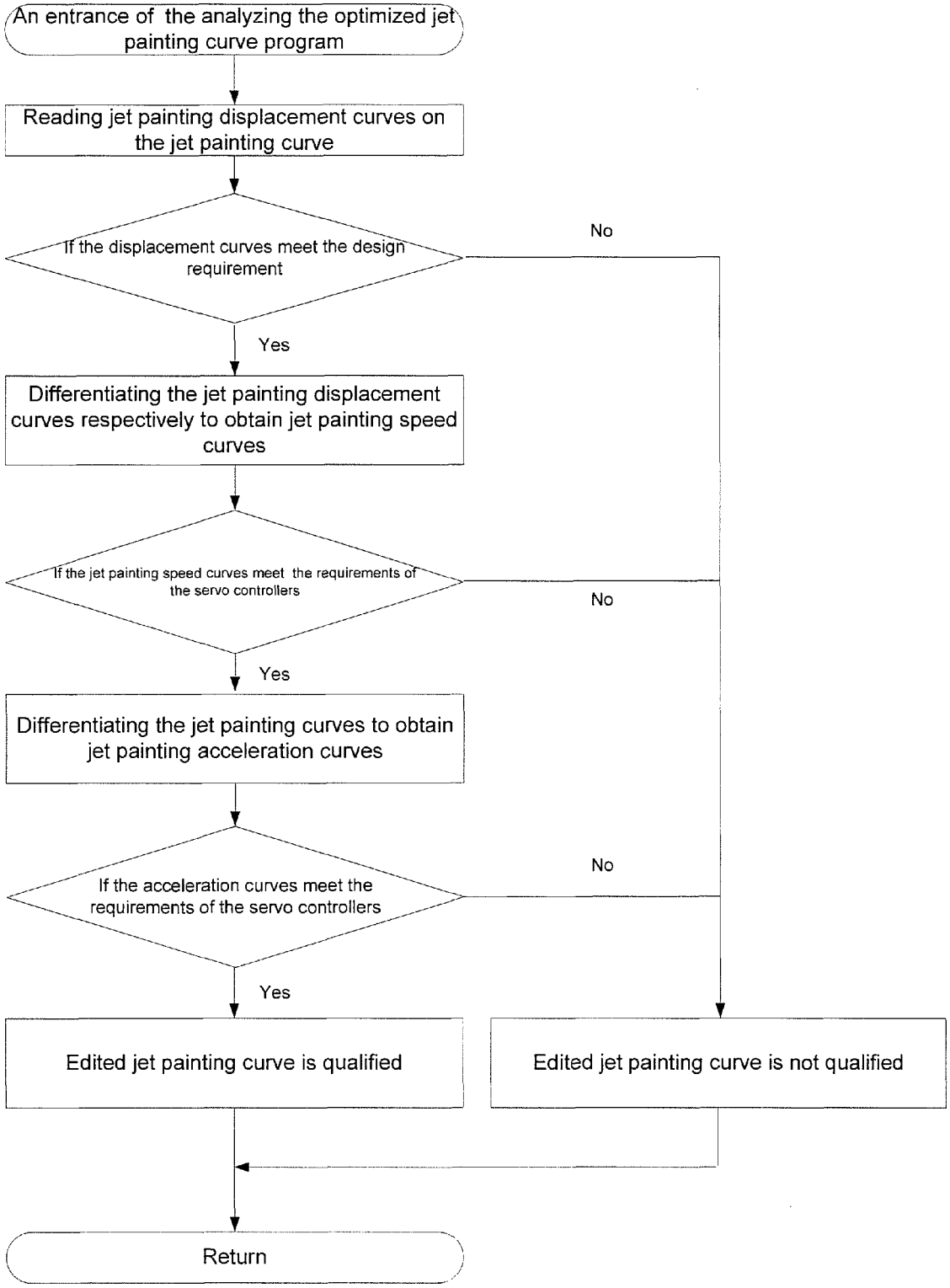
FIG. 5 is a flow chart of the sub-program of analyzing the optimized jet painting curve of the sub-program of editing jet painting formulation of the control process.

The step of analyzing the optimized jet painting curve includes carrying out displacement curve analysis, speed curve analysis, acceleration curve analysis upon the optimized curve and the detailed step is as shown in FIG. 5: reading X-axis and Y-axis jet painting displacement curve on the jet painting curve; determining whether the above mentioned displacement curves meet the design requirement, if an answer is 'yes', differentiating X-axis and Y-axis jet painting displacement curve respectively to obtain X-axis and Y-axis jet painting speed curve; determining whether X-axis and Y-axis jet painting speed curves meet the requirements of the servo controllers, if the requirements are met, differentiating X-axis and Y-axis jet painting curves respectively to obtain X-axis and Y-axis jet painting acceleration curves; then determining whether the acceleration curves meet the requirements of the servo controllers, when the answer is 'yes', it means that the edited jet painting curves are qualified; after that returning back to the sub-program of editing jet painting formulation to determine if the optimized curves are qualified; if at lest one of the above mentioned results of determination is not satisfactory, it means that the edited jet painting curve is not qualified, returning back to the sub-program of editing formulation to determine whether the optimized curves are qualified in the same way as well; however, if the answer of the determination over this step is 'no' satisfactory, returning back to the step of optimizing jet painting curve and continue to optimize the said curve; Repeating the process above until the displacement curves, speed curves and acceleration curves have met their own requirements correspondently.

Figure 6:
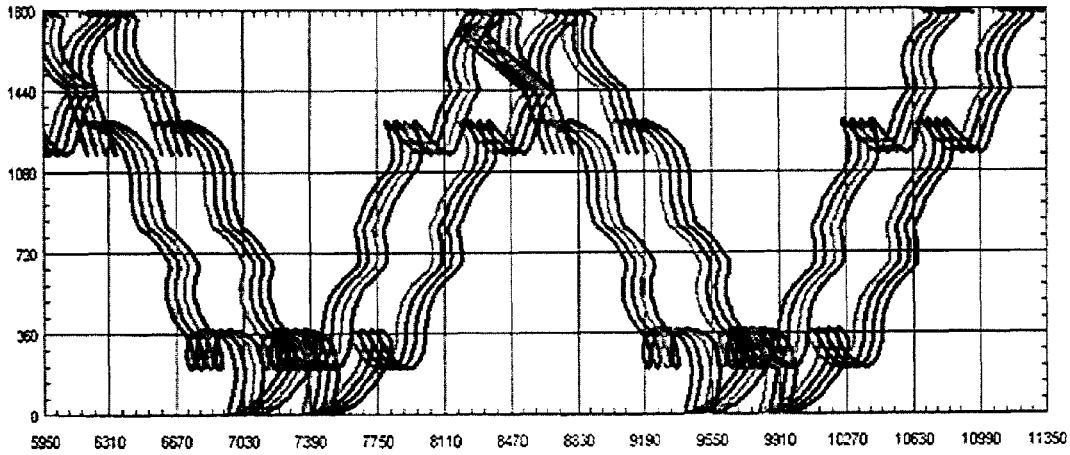
FIG. 6 is a diagram of a stimulating display of jet painting result by applying control method given by the superior monitor computer.

The above mentioned stimulating display result of jet painting is done through loading the optimized curves into the superior monitor computer by curve display controlling piece. The result is as shown in FIG. 6.

D. Downloading jet painting formulation into the servo controllers.

The optimized two dimensional jet painting curve which is edited on the superior monitor computer is broken down into X-axis and Y-axis curves and then further scattered into 64-1024 points (this point range being based on the capacity of the memory of the servo controllers).

The scattered points are downloaded into the memories of the X-axis and Y-axis servo controllers respectively as the X-axis jet painting curve and Y-axis jet painting curve.

E. Starting up the servo controllers and carrying out the operation of jet painting by the electronic cams.

Some regular types of jet painting curves, such as sinusoidal, saw-teeth wave and etc., are stored in the superior monitor computer. Users may use one of them and the same curve with in the whole operation area, each curve can be broken down into sections and then made the beginning and the end combinational connection in the whole operation area. Simultaneously the curve editing and optimizing can be done by means of hand drawing. As the optimized curves are determined, the superior monitor computer will carry out sampling analysis upon the determined curves and download the coordinates of each point, which describe the operation orbit of the curve, into memories of the servo controllers. The X-axis and Y-axis servo controllers then read the jet painting curve data from these memories and drive the X-axis and Y-axis servo motors in the robot to operate within the printing and dyeing plane for jet painting operation.

In practical application the complete set of intelligent waterless printing and dyeing equipment may be simply controlled for jet painting by operating the graphics user interface of the superior monitor computer.

The jet painting operation given in this example is based on the downloaded data of printing patterns from the superior monitor computer and is executed by two electronic cams which are established respectively in the servo controllers based on the X-axis and Y-axis displacement. The synchronization there with is realized through the establishment of virtual main shaft in X-axis servo controller.

What we claimed:

1. An intelligent waterless printing, and dyeing control equipment comprising; a dye conveyer apparatus and a printing and dyeing apparatus connecting to a terminal of the dye conveyer apparatus; and a control apparatus which is comprised of a programmable logic controller, a superior monitor computer and a robot, wherein, the programmable logic controller communicates with the superior monitor computer, receiving control signal coming from an operating panel and the robot via digitals input module and transmitting the control signals' command to servo controllers of the robot, connecting with the dye conveyer apparatus and electric execution devices in the printing and dyeing apparatus via the digitals output module, and connecting with the servo controllers of the robot via relays; the superior monitor computer communicates with the servo controllers; nozzles of the printing and dyeing apparatus are mounted on the robot forming an interlock system with each other; a control program is stored in the superior monitor computer, and wherein said robot is installed on printing and dyeing framework with one or more groups of plane rectangular structure, each group having an X-axis servo motor and a Y-axis servo motor controlled by an X-axis servo controller or a Y-axis servo controller respectively; an effective travel of the X-axis and Y-axis servo motors forming a printing and dyeing plane, position feedback sensors on each axis servo motor feed back the position signals to the servo controllers; a digital frequency output terminal of the X-axis servo controller connects with a digital frequency input terminal of the Y-axis servo controller; an enabling servo controller input terminal connects with the contact points of the relays controlled by the programmable logic controller; both the X-axis servo motor and the Y-axis servo motor change rotating movement into rectilinear movement of X-axis and Y-axis via a drive mechanism as to control the movement of the nozzles in the printing and dyeing apparatus.

2. The intelligent waterless printing and dyeing control equipment according to claim 1, wherein, the X-axis servo motor, which is mounted on the printing and dyeing framework, connects with a Y-axis rail via a drive mechanism; tile Y-axis servo motor on a Y-axis rail connects with a sliding block mounted on the Y-axis rail via the drive mechanism; the nozzles on the sliding block form an interlock system together with the sliding block; both the X-axis and Y-axis rails are of a, horizontal mounting and perpendicular position to each other.

3. The intelligent waterless printing and dyeing control equipment according to claim 1, wherein electronic cams are established in the X-axis and Y-axis servo controllers, by making use of their interior function block, respectively, through displacement on the X-axis and Y-axis according to data of printing pattern edited by the superior monitor computer; moreover, a virtual main shaft is established in the X-axis servo controller, wherein, speed of the virtual main shaft is transmitted to the digital frequency input terminal of the Y-axis servo controller via the digital frequency output terminal of the X-axis servo controller and, in this way, to realize the movement of X-axis and Y-axis by following up the same virtual main shaft

4. The intelligent waterless printing and dyeing control equipment according to claim 1, wherein the electric execution devices refer to the solenoid valves installed in the dye conveyers apparatus and the printing and dyeing apparatus.

5. The intelligent waterless printing and dyeing control equipment according to claim 1, characterized in that high-speed solenoid valves connecting with the programmable logic controller are set on the nozzles; the programmable logic controller receives parameters of open/close time setting up by the superior monitor computer for controlling the open/close operation of the high-speed solenoid valves through an establishment of different combinations of solenoid valve time resulting in development of diversification of a printing pattern.

6. The intelligent waterless priming and dyeing control equipment according to claim 1, wherein the superior monitor computer processes a graphics user interface input.

7. The intelligent waterless printing and dyeing control equipment according to claim 1, wherein the said superior monitor computer connects with other remote computers through a local area network.

8. An intelligent waterless printing and dyeing control method for operating the intelligent waterless printing and dyeing control equipment of claim 1, comprising: implementing the control program stored in the superior monitor computer, setting up a Y-axis in cloth operational direction and an X-axis in the direction which is perpendicular to the cloth operational direction to establish a plane of printing and dyeing;

setting up an X-axis electronic cam and a Y-axis electronic cam, which use a same virtual main shaft in the servo controllers;

editing jet painting formulation in a graphics user interface of the superior monitor computer;

downloading edited jet painting formulation into the servo controllers;

starting up the servo controllers and completing the jet painting operation through the electronic cams.

9. The intelligent waterless printing and dyeing control method according to claim 8, wherein the steps of editing the jet painting formulation include:

editing jet painting curve;

optimizing the jet painting curve;

analyzing the optimized jet painting curve;

determining Whether the optimization meets the technical criteria of jet painting;

stimulating to display the jet painting result while meeting the technical criteria of jet painting;

judging whether the jet painting effect is satisfactory;

preserving the jet painting curve when the jet painting result is satisfactory;

setting up parameters for the servo controllers and solenoid valves and returning back to the main program.

10. The intelligent, waterless priming and dyeing control method according to claim 9, wherein returning back to the step of optimizing jet painting curve occurs if the result of optimization does not meet the technical criteria of jet painting; and returning back to the step of editing jet painting curve occurs when the effect of jet painting is not satisfactory.

11. The intelligent waterless printing and dyeing control method according to claim 8, wherein the editing of the printing and dyeing curve includes: generating a regular jet painting through curve function, or drawing a two dimensional jet painting curve in specified area to control a mouse by using a timer, or forming a new jet painting curve by intercepting any piece from a regular curve and a hand drawn curve.

12. The intelligent waterless printing and dyeing control method according to claim 11, wherein, a cycle and an amplitude of the regular jet painting curve are set up by parameters.

13. The intelligent waterless printing and dyeing control method according to claim 8, wherein the steps of optimizing let painting curve include:

reading a jet painting displacement curve;

judging whether the displacement curve is complete;

trimming the curve(s) when the above displacement curve judgment is not satisfactory;

calculating the varying rate of the curve in the commencing section;

calculating the cycle and amplitude of the sinusoidal which has identical varying rate of the curve;

replacing an original jet painting curve in the commencing section with one-fourth wavelength sinusoidal;

calculating, the varying rate of the jet painting curve in the terminating section;

calculating the cycle and amplitude of the sinusoidal which has identical varying rate of the curve in the terminating section;

replacing an original jet painting curve in the terminating section with one-fourth wavelength sinusoidal;

carrying out mean filtering for the jet painting curve and realizing a smooth optimization for displacement curve on the X-axis and Y-axis;

returning back to the sub-program of the editing jet painting curve and continuing the step of analyzing the optimized jet painting curve.

14. The intelligent waterless printing and dyeing control method according to claim 8, wherein the steps of analyzing the optimized jet painting curve include:

reading the jet painting displacement curves on the X-axis and Y-axis among the jet painting curves;

judging whether the displacement curves meet the design requirements;

differentiating the displacement curves on the X-axis and Y-axis respectively to obtain X-axis and y-axis jet painting speed curves while meeting the design requirements;

judging whether the X-axis and Y-axis jet painting speed curves meet the requirements of the servo controllers;

differentiating the speed curves on X-axis and Y-axis to obtain the X-axis and Y-axis acceleration curves while meeting the requirements of the servo controllers;

judging whether the X-axis and Y-axis acceleration curves meet the requirements of the servo controllers;

qualifying the edited jet painting curves by meeting the requirements of the servo controllers, and then returning hack to the sub-program of editing the jet painting for mutation to continue the step of judging whether the optimized curves are qualified.

15. The intelligent waterless printing and dyeing control method according to claim 14, wherein the edited jet painting curves are deemed unqualified due to at least one out of the above mentioned results of judgment being not acceptable, then returning back to the sub-program of editing formulation and continuing to go through the step of judging whether the optimized curves are qualified.

16. The intelligent waterless printing and dyeing control equipment according to claim 1 wherein the programmable logic controller communicates with the superior monitor computer via a bus linkage.

17. The intelligent waterless printing and dyeing control equipment according to claim 16 wherein the bus linkage is an MPI bus.

18. The intelligent waterless printing and dyeing control equipment, according to claim 16 wherein the control signals' command to servo controllers of the robot are via a robot linked bus device, and wherein the superior monitor computer communication with the servo controller is via a bus link.

19. the intelligent waterless printing and dyeing control equipment according to claim 18 wherein the bus link is a CAN bus.

20. The intelligent waterless printing and dyeing control equipment according to claim 1 wherein the superior monitor computer is configured to supply curve formation data to the X-axis and Y-axis servo controllers.

* * * * *